US005110225A

United States Patent [19]

Uchiyama

[11] Patent Number: 5,110,225

[45] Date of Patent: May 5, 1992

[54] MANUAL PRINTER

[75] Inventor: Yasuyuki Uchiyama, Tokyo, Japan

[73] Assignee: Mutoh Industries Ltd., Tokyo, Japan

[21] Appl. No.: 531,685

[22] Filed: Jun. 1, 1990

[30] Foreign Application Priority Data

Jul. 27, 1989 [JP] Japan ..... 1-88249[U]

[51] Int. Cl.[5] ..... B41J 3/28

[52] U.S. Cl. ..... 400/29; 400/23; 400/36; 400/62

[58] Field of Search ..... 400/21, 23, 36, 62, 400/193, 88, 29, 30, 31

[56] References Cited

U.S. PATENT DOCUMENTS

| | | | |
|---|---|---|---|
| 3,228,507 | 1/1966 | Young | 400/29 |
| 4,195,567 | 4/1980 | Mitter | 101/115 |
| 4,635,219 | 1/1987 | Howard | 400/88 |

FOREIGN PATENT DOCUMENTS

| | | | |
|---|---|---|---|
| 0138444 | 4/1985 | European Pat. Off. | 400/88 |
| 0084880 | 5/1982 | Japan | 400/23 |
| 114078 | 6/1984 | Japan | 400/88 |
| 240472 | 11/1985 | Japan | 400/29 |
| 32771 | 2/1986 | Japan | 400/29 |
| 0064469 | 4/1986 | Japan | 400/88 |
| 0125360 | 5/1988 | Japan | 400/193 |

*Primary Examiner*—Edgar S. Burr
*Assistant Examiner*—Ren Yan
*Attorney, Agent, or Firm*—Wenderoth, Lind & Ponack

[57] ABSTRACT

A manual printer has a casing of a shape suitable for mounting on a table, a guide rail installed in the casing, a guide member movably connected to the guide rail, a base supported on the cursor and projecting outwardly through a front opening of the casing, a printing head attached to the base, a controller contained in the casing, a switch panel installed in the casing, a display secured to the casing so as to display printing data, and an ink ribbon cassette arranged in the base. In a printing operation, an operator inputs the printing data to the memory of the controller and the base is moved by hand along the guide rail in order to have the printing head print words and the like onto paper sheets.

4 Claims, 6 Drawing Sheets

MANUAL PRINTER

BACKGROUND OF THE INVENTION

The present invention relates to a manual printer for precisely and correctly printing words and the like at desired positions on paper sheets on a table.

In conventional manual printers, a printing portion, a controller, a switch panel or board, and a display portion are installed integrally on the casing body of the manual printer.

As the conventional manual printer has the output or printing portion and the input portion, respectively integrally installed or assembled with the casing of the printer, it is necessary to reduce the overall weight of the printer and, therefore, to miniaturize its construction. With such miniaturization, the size of the input portion of the compact printer is reduced, thereby making it difficult to input information. In addition, the memory capacity is disadvantageously restricted. In such arrangements, it is necessary to install, for example, guide frames and the like, prepared separately, to guide the casing during printing in order to raise the precision of printing on the paper sheets.

SUMMARY OF THE INVENTION

It is the purpose of the present invention to provide a unique manual printer improved to solve the disadvantages above.

Accordingly, the present invention comprises a manual printer for use in printing on paper set on a mounting face. The printer includes a casing adapted to be mounted on the mounting face, an elongated guide rail mounted in the casing, a guide member, and means for mounting the guide member to the guide rail for movement therealong. A base is secured to the guide member outwardly of the casing, and a printing means, for printing on the paper is mounted to the base. A control means is provided for controlling printing by the printing means as the guide member is moved along the guide rail, and an input means is provided for inputting data to the control means.

DESCRIPTION OF THE PREFERRED EMBODIMENT

The construction of the manual printer according to the present invention will be explained with reference to the accompanying drawings.

Figure 1:
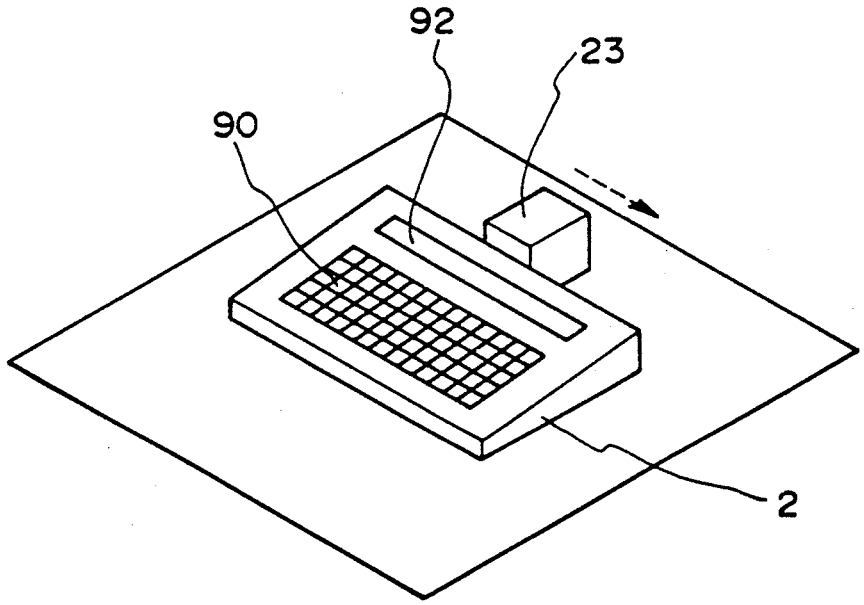
FIG. 1 is a schematic perspective view of a manual printer according to the present invention.
Figure 2:
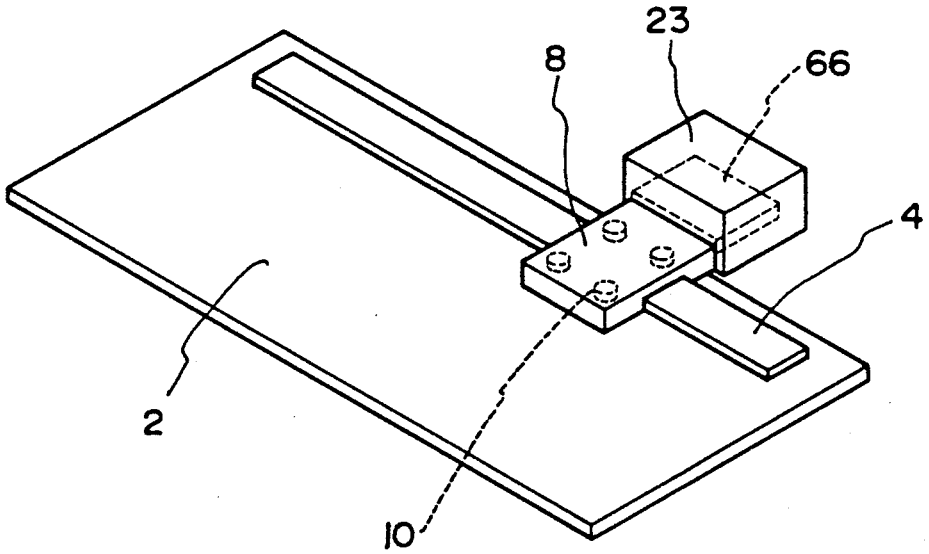
FIG. 2 depicts an interior of a casing of the manual printer
Figure 4:
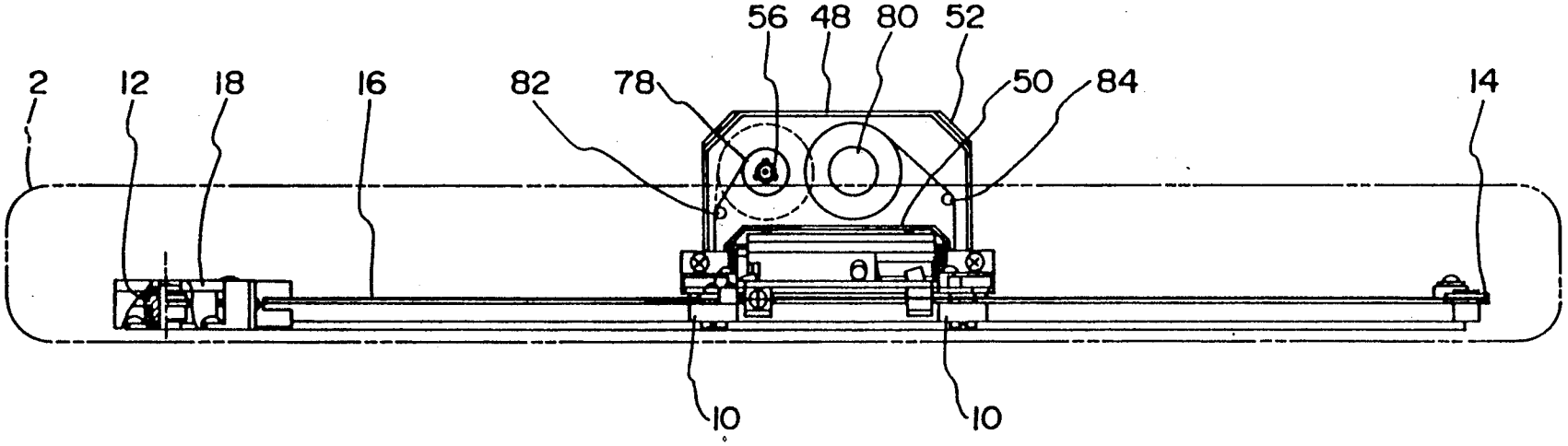
FIG. 4 is a rear view of the casing.
Figure 5:
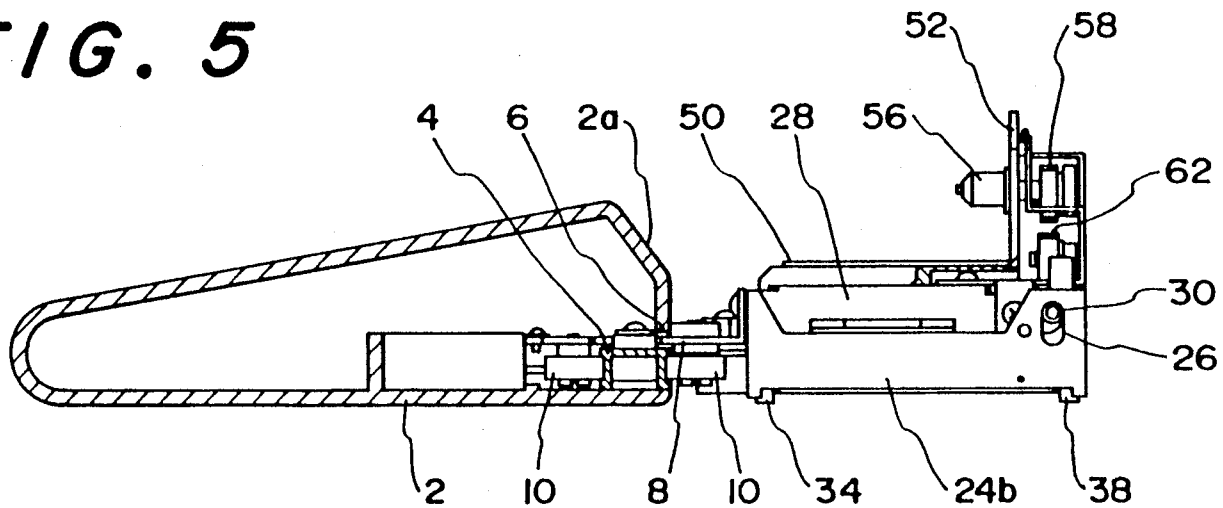
FIG. 5 is a side view of the printer.

The casing 2 of the manual printer has a guide rail 4 secured to a bottom plate of the printer as shown in FIG. 2. The guide rail 4 is placed near the front edge of the casing 2 in parallel with the front edge. An opening

Figure 9:
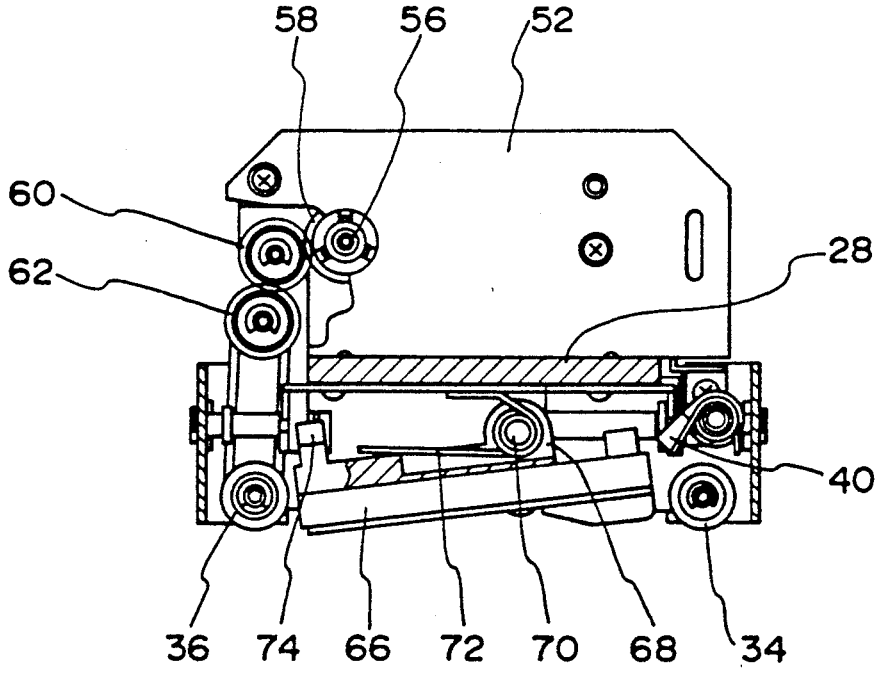
FIG. 9 is a rear view similar to FIG. 8, and FIGS. 10 and 11 are rear views of an ink ribbon cassette.
Figure 10:
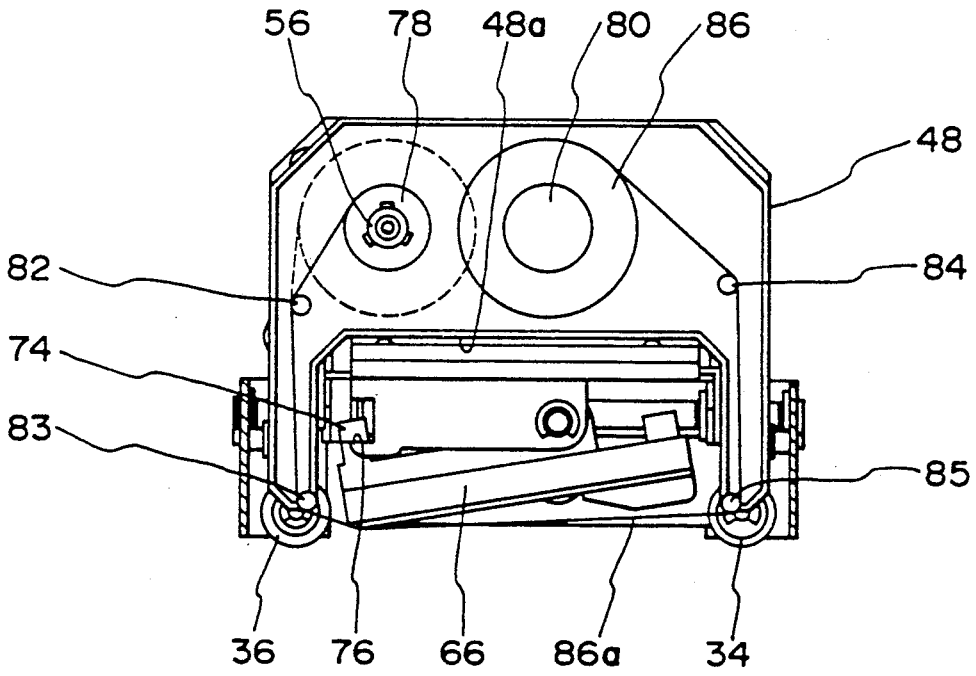

6 is formed on a front wall 2*a* of the casing 2 in parallel with the front wall, extending along substantially the entire length of the front wall 2*a*. A guide member 8 is engaged with the guide rail 4 by means of four rollers 10. The guide member 8 is loosely engaged with the opening 6 and the front edge of guide member 8 projects forwardly of the casing 2. A pair of rope pulleys 12 and 14 are rotatably journaled to the bottom wall of the casing 2, and an endless wirerope 16 is trained about these pulleys with suitable tension. One of the parallel opposing portions of the wirerope 16 trained about the pulleys 12 and 14 is connected to the guide member 8. An input shaft of a pulse encoder 18 is connected to a rotary shaft of the pulley 12. The casing 2 has a controller (not shown) therein and the controller is connected to a connector 20 installed on the guide member 8 by a tape-like electric wire 22. A base 24 is secured to a vertical portion of the guide member 8. Both side frames 24*a* and 24*b* of the base 24, respectively have vertically oblong holes or elliptical openings 26 formed therethrough. A head base 28 is loosely arranged in a space of the base 24, and is adapted to be pivoted between raised and lowered positions. In the front of the space between the side frames 24*a* and 24*b* of the base 24, a pair of rotary shafts 30 are mounted to extend between the side frames 24*a* and 24*b*. These rotary shafts 30 are slidably fitted in the oblong holes 26. Each rotary shaft 30 is urged upwardly in the oblong holes 26 by means of springs 32 secured to the base 24. At four corners of the base 24, there are rollers 34, 36, and 38 (one roller is not shown) rotatably journaled thereto. On one vertical wall of the base 24, there is mounted a pair of vertically movable stoppers 40 and 42. These stoppers 40 and 42 are urged horizontally by means of springs 44. On the head base 28, an engagement face 46 is formed so as to correspond with these stoppers 40 and 42. The head base 28 has a cassette supporting portion formed therein, which consists of a mounting face 50 and a restriction plate 52, for removably supporting an ink ribbon cassette 48. An ink ribbon drive shaft 54 is rotatably supported by the restriction plate 52. A winder and take-up shaft 56 is secured to one end of the drive shaft 54 and a toothed gear 58 is secured to another end thereof. A toothed gear 60 is rotatably journaled to the head base 28 and engaged with the toothed gear 58. A toothed gear 62 is rotatably journaled to the base 24 and is spaced from the gear 60 by a predetermined distance. Between and around the toothed gear 62 and the roller 36, an endless belt 64 runs so as to transfer rotary power of the roller 36 to the toothed gear 62. A thermal-point head 66 has a bracket 68 secured thereto, and the bracket 68 is rotatably journaled to the head base 28 through a shaft 70. The head 66 is urged or pressed to rotate counterclockwise in the plane of FIG. 9 around the shaft 70 by means of a spring 72. A projected member 74 integrally formed on the thermal-print head 66 is resiliently engaged with a stopper 76 installed at a side of the head base 28. The ink ribbon cassette 48 has an ink ribbon winding roller 78, an ink ribbon supply roller 80, and respective guide shafts 82, 83, 84, 85, respectively installed therein. An ink ribbon 86 is installed on the supply roller 82. The winding roller 78 has a hole within which the take-up shaft 56 is engaged so that the winding roller 78 rotates with the shaft 56. The ink ribbon cassette 48 has an insert frame 48*a* used to removably fit or apply the cassette 48 to the cassette supporting portion of the head base 28. The thermal-print head 66 is connected to the controller through the tape-like electric wire 22, and the output end of the pulse encoder 18 is connected to the controller. Printing information is inputted to the controller through key operation of the panel switches 90 formed on the casing 2 or by inputting data from a host computer connected to the controller. The manual printer has a display 92. The head base 28 having the base 24 and the printing head 66 is a part of the head portion 23 of the manual printer according to the present invention.

The operation of the embodiment will be described with reference to the accompanying drawings. First, operation of the ink ribbon cassette 48 fitting into the head base 28 will be described.

Figure 7:
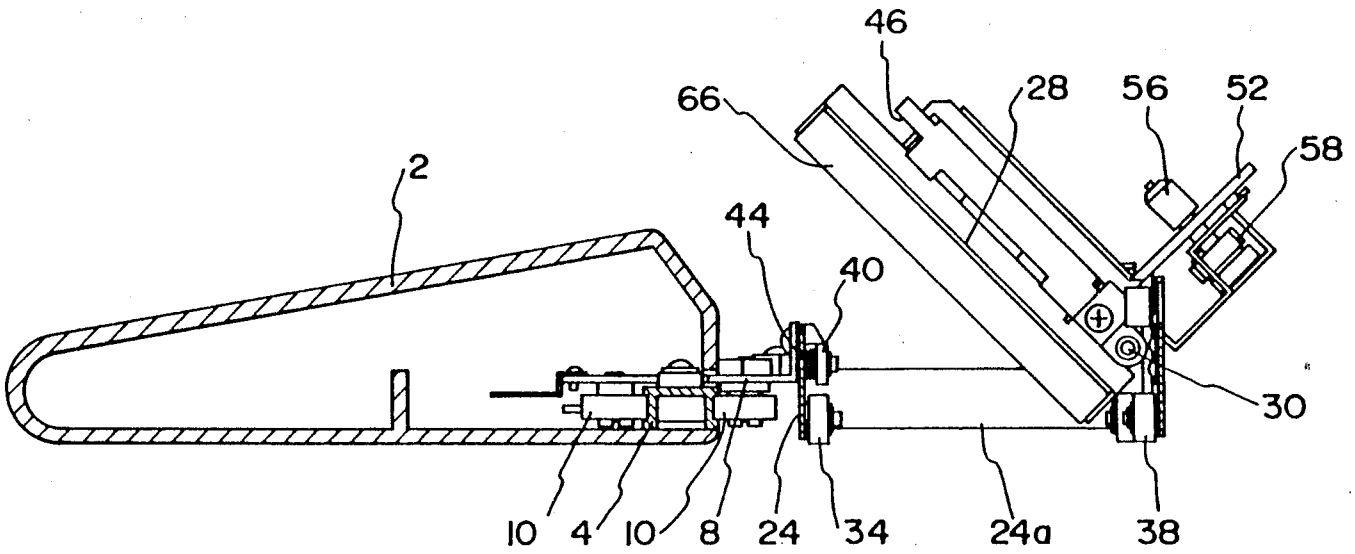
FIG. 7 is a side view of a part of the printer.

The head base 28 is manually raised by rotating it clockwise as shown in FIG. 7 around the center of the shafts 30 mounted in the oblong holes 26 formed in the frames 24*a* and 24*b*, resulting in a slanting of the head base 28 at about 45 degree relative to the plane of the table. The slanting of the head base 28 opens the lower portion of the printing head 66. Then, the fitting portion 48*a* of the ink ribbon cassette 48 is inserted into the head base 28, and a portion 86*a* of the ribbon 86 extending out of the ink ribbon cassette 48 is applied to the bottom face of the printing head 66. Then, the cassette 48 is pushed against the restriction plate 52 in order to make contact between the bottom face of the cassette 48 and the restriction plate 52. In this situation, the winding shaft 56 is engaged with the winding roller 78. Next, the head base 28 is rotated clockwise (as seen in FIG. 7) around the center of the shafts 30 mounted in the oblong holes 26 in order to mount the engagement face 46 of the head base 28 on the stoppers 40 and 42 due to the weight of the head base 28. Then, in this condition, the head base 28 is made substantially horizontal relative to the plane of the table or other mounting face on which the head base is mounted.

Next, a printing operation carried out on a paper sheet on the table will be explained.

Figure 3:
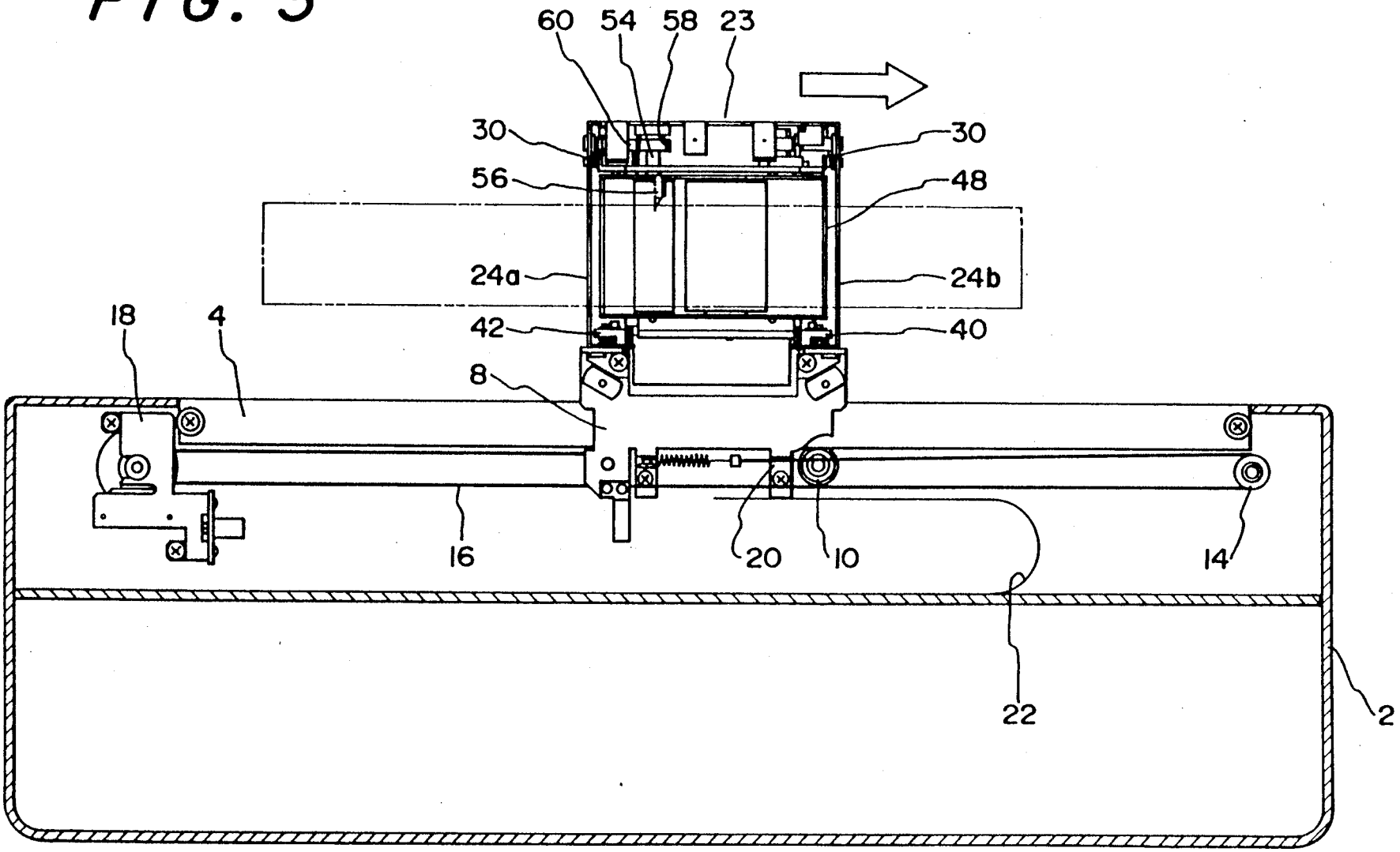
FIG. 3 is a plan view in detail of the interior of the casing.
Figure 6:
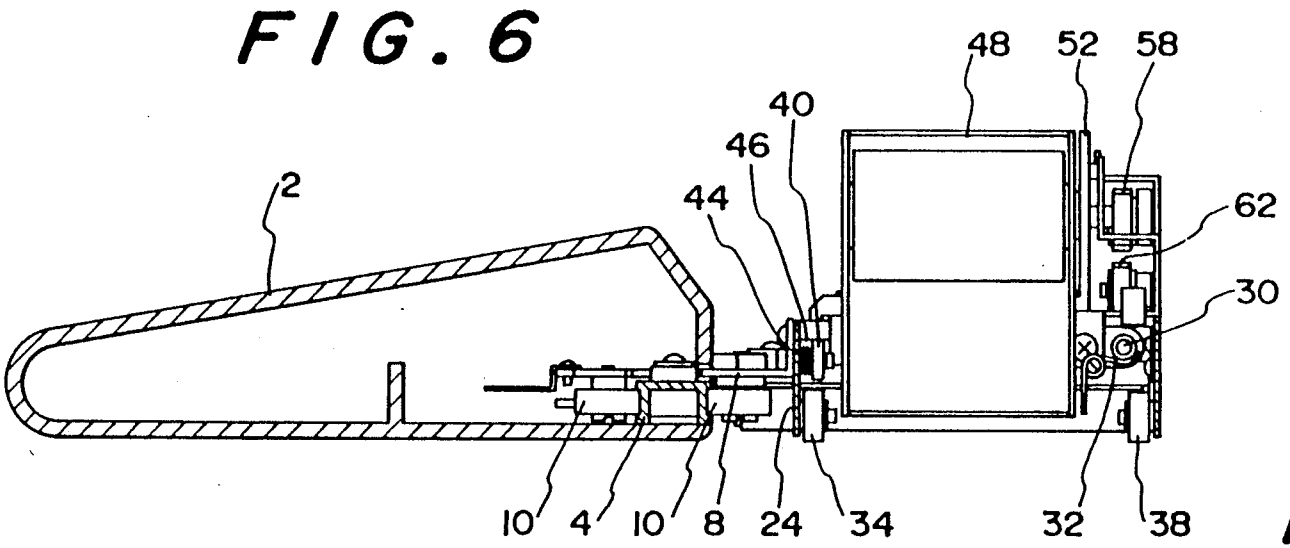
FIG. 6 is a side view of a part of the printer.

Previously, the panel keys 90 were operated in order to input the printing information to the controller. The casing 2 is placed on the sheet set on the table at the desired position. The operation start switch is turned ON. Then, an operator moves the guide member 8 along the guide rail 24 toward the left in FIG. 3 and the guide member 8 is placed at the left end of the printing range of the manual printer. Next, the operator pushes the head base 28 downwardly such that the head base 28 is guided along the oblong holes 26 against the forces of the springs 32 and 44 and descends vertically relative to the table face or plane until the toothed wheel or gear 60 engages with the toothed gear 62.

Figure 8:
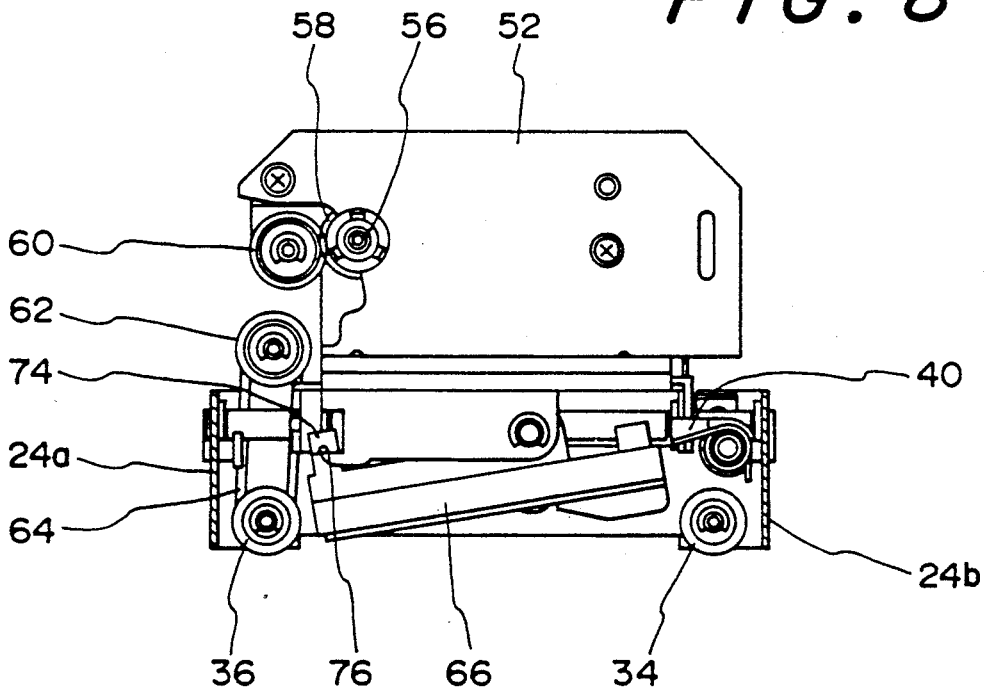
FIG. 8 is a rear view of the printer.
Figure 11:
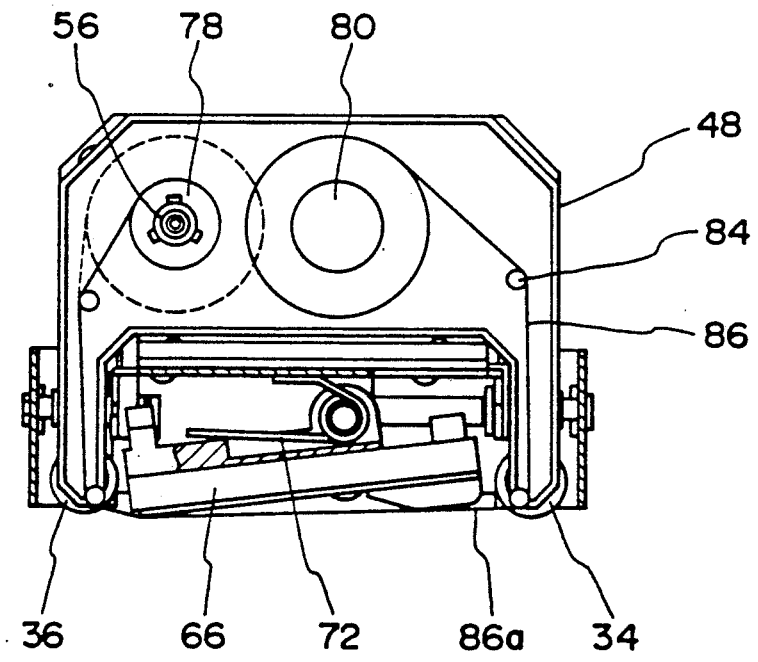

Lowering of the head base 28 presses the printing head 66 against paper sheet on the table through the ink ribbon 86. Due to reaction force of the table, the printing head 66 rotates slightly clockwise about the shaft 70 against the resilient force of the spring 72 as shown in FIG. 11. When the operator then moves the head base 28 along the guide rail 24 toward the right in FIG. 3, rollers 34, 36, and 38, respectively rotate clockwise (as viewed in FIG. 8). The rotational movement of the roller 36 is transferred to the winding shaft 56 through toothed gears 62, 60, 58 and the ink ribbon drive shaft 54 in order to rotate the winding roller 78. Rotation of the roller 78 makes the ink ribbon 86 wind around the winding roller 78 so as to continuously supply the ink ribbon 86 to the printing head 66 according to the movement of the head base 28 along the guide rail 4. The motion of the guide member 8 along the guide rail 4 is changed to pulse signals by means of the pulse encoder 18 and the pulse signals are fed back to the controller. The controller controls the timing of the output of the printing data from the printing head 66, and the desired printing is carrier out on the paper sheet at the position at which the printing head 66 contacts by the paper sheet.

It is noted that the manual printer has a structure as described above comprising the casing part and the base part provided with the printing head, and only the base part travels. Therefore, it is possible to reduce the weight of the movable structure for a printing operation. In addition, the base part of the printer is moved along the guide rail formed on the casing, so that it is possible to improve the travelling precision and to thereby carry out a correct printing operation.

What is claimed is:

1. A manual printer for use in printing on paper set on a mounting face, comprising:

a casing adapted to be mounted on the mounting face;

an elongated guide rail mounted in said casing;

a guide member;

means for mounting said guide member to said guide rail such that said guide member is movable longitudinally along said guide rail;

a base secured to said guide member and located outwardly of said casing, said base comprising a base frame secured to said guide member and a head base pivotably mounted to said base frame for movement between raised and lowered positions;

printing means, mounted to said base, for printing on the paper;

control means for controlling the printing by said printing means as said guide member is moved along said guide rail; and input means for inputting data into said control means.

2. A manual printer as recited in claim 1, further comprising:

display means for displaying data input by said input means.

3. A manual printer as recited in claim 1, wherein said mounting means comprises a plurality of rollers.

4. A manual printer as recited in claim 1, wherein said casing encloses and covers said elongated guide rail and at least a portion of said guide member.

* * * * *